United States Patent [19]

Grosh

[11] 3,974,599

[45] Aug. 17, 1976

[54] UNDERGROUND REINFORCED PLASTIC ENCLOSURE

[75] Inventor: James L. Grosh, Los Altos, Calif.

[73] Assignee: Indian Head Inc., New York, N.Y.

[22] Filed: Mar. 20, 1975

[21] Appl. No.: 560,372

Related U.S. Application Data

[63] Continuation of Ser. No. 205,991, Dec. 8, 1971, abandoned.

[52] U.S. Cl. ..... 52/20; 52/169 R; 52/309

[51] Int. Cl.[2] ..... E02D 29/14

[58] Field of Search ..... 52/19, 20, 21, 169, 52/245, 615, 309; 137/363, 364, 366, 371; 174/37; 176/163, 164; 220/4 B, 4 C, 4 F, 18; 704/25, 4, 5

[56] References Cited

UNITED STATES PATENTS

| | | | |
|---|---|---|---|
| 1,258,839 | 3/1918 | Wheeler | 52/20 |
| 2,857,932 | 10/1958 | Calderwood | 138/141 |
| 3,150,032 | 9/1964 | Rubenstein | 52/DIG. 7 |
| 3,150,792 | 9/1964 | Bright | 220/9 R |
| 3,390,225 | 6/1968 | Couch et al. | 52/20 X |
| 3,516,541 | 6/1970 | Hardingham | 210/164 |
| 3,672,103 | 6/1972 | Kost | 52/20 X |
| 3,717,963 | 2/1973 | Sauriol | 52/19 X |
| 3,837,989 | 9/1974 | McCoy | 52/309 |

*Primary Examiner*—Price C. Faw, Jr.
*Assistant Examiner*—Carl D. Friedman
*Attorney, Agent, or Firm*—Jack M. Wiseman

[57] ABSTRACT

An underground reinforced plastic enclosure comprising a vertically and circumferentially stiffened body. The body is made of a fiberglass polyester resin and the stiffeners are of a reinforced plastic mortar. The body is suitable for surrounding a transformer or an oil switch used in underground utilities. On the body is seated a top cap made of reinforced plastic mortar. The top cap is formed with a central opening. Seated on the top cap is a reinforced plastic mortar cover plate or a metal grate. Depending from the top cap is a fiberglass polyester resin baffle and tamper shield. The body seats on a base of reinforced plastic mortar. A grade adjustment skirt also depends from the top cap outwardly from the baffle and tamper shield.

11 Claims, 7 Drawing Figures

Fig. 1
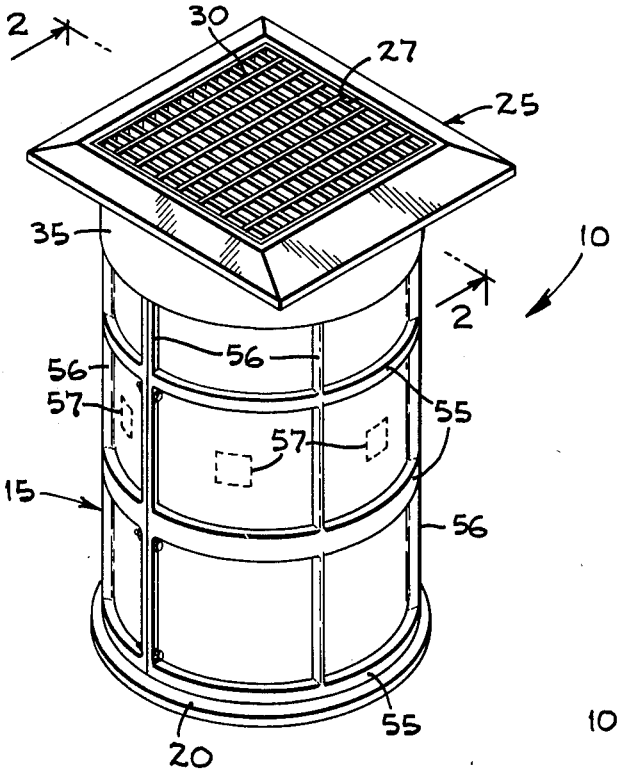
Fig. 3
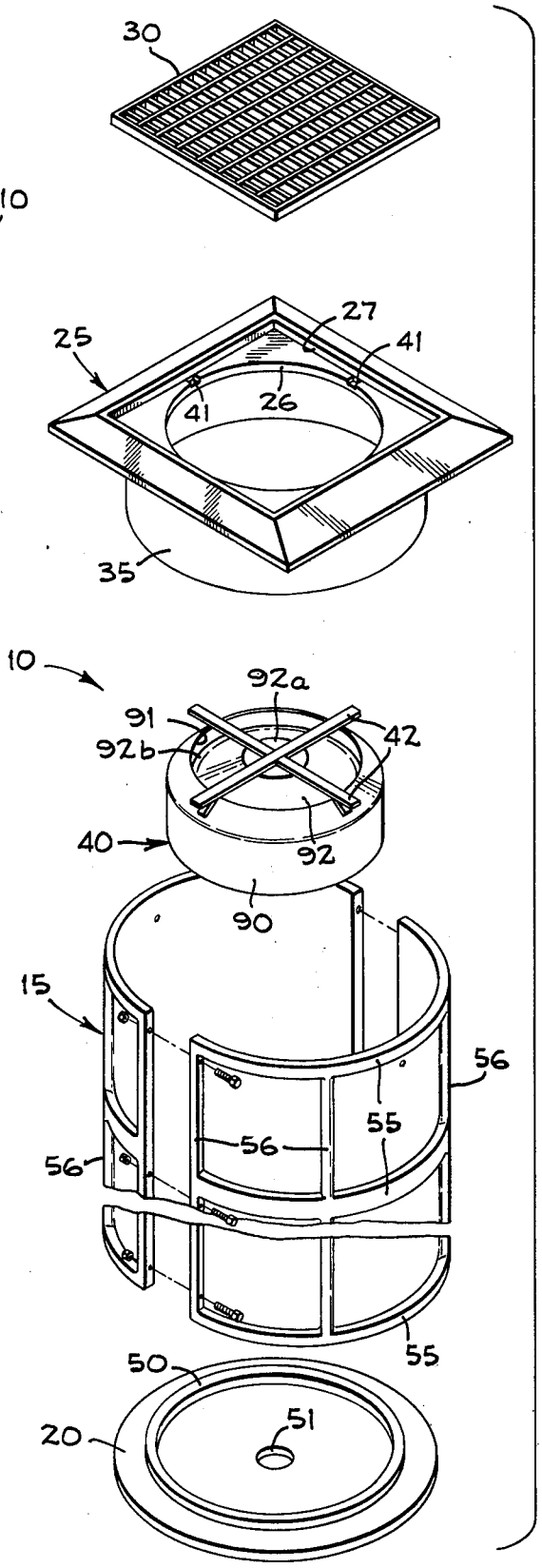
Fig. 4
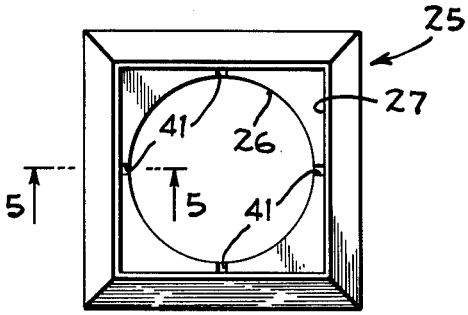
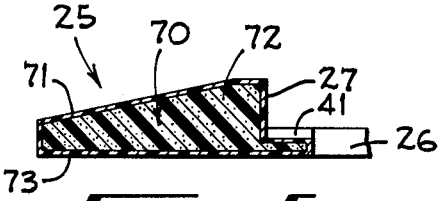
Fig. 5

Fig_2
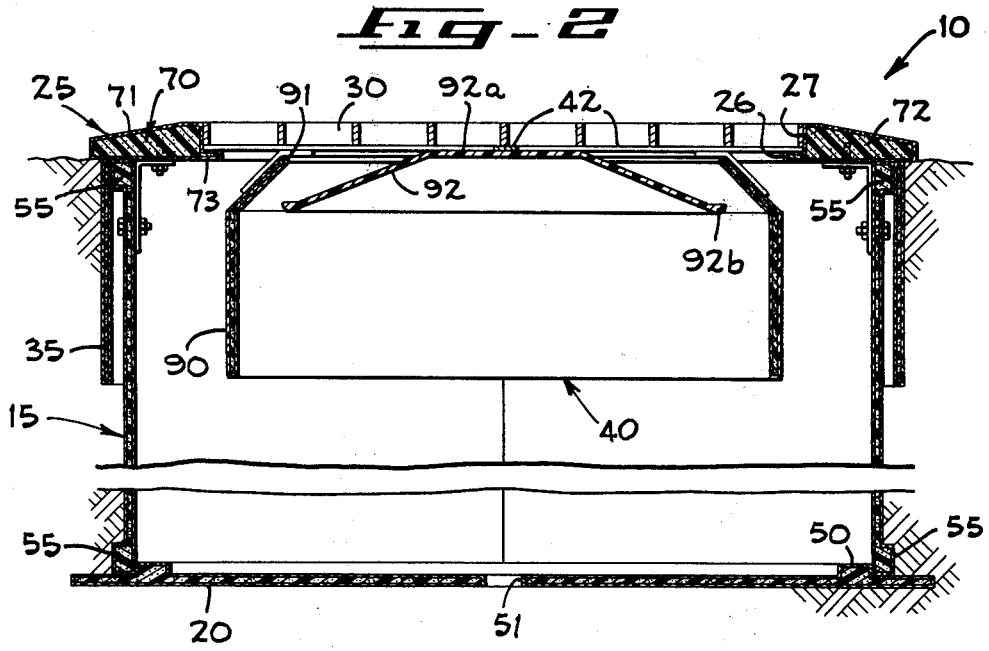
Fig_7
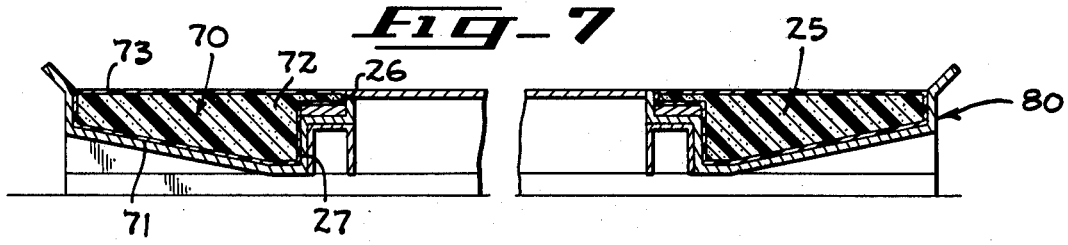
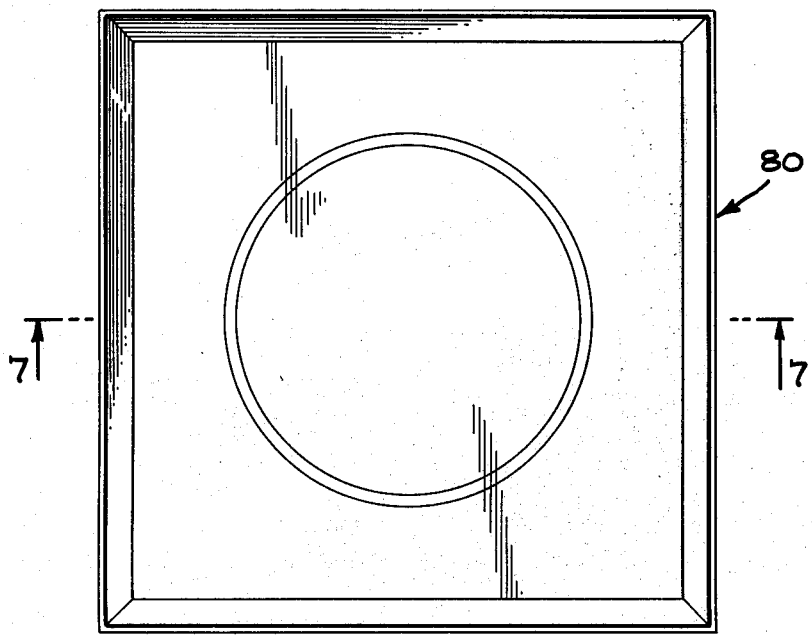
Fig_6

UNDERGROUND REINFORCED PLASTIC ENCLOSURE

RELATED APPLICATIONS

The present application is a continuation application of an application filed by James L. Grosh, Ser. No. 205,991, filed on Dec. 8, 1971, for Underground Reinforced Plastic Enclosure, which application Ser. No. 205,991 has been abandoned.

BACKGROUND OF THE INVENTION

The present invention relates in general to underground enclosures and more particularly to an underground vault or manhole for housing underground utility units such as transformers, oil switches, or other units for electrical, communication, water, sewer, gas, telephone and cable television equipment.

Heretofore, underground vaults and manholes for utilities were made of reinforced concrete or from an assembly of reinforced concrete and bituminous fiber. Such vaults and manholes generally included a tubular member which was disposed vertically in the soil; a top cap disposed at ground level and seated on the tubular member; a grating or cover plate which was seated on the top cap. The top cap had a central opening and the grating or cover plate could be removed to gain access to the tubular member. Additionally, such vaults or manholes also included baffles and base plates. The tubular member was seated on the base plate and the baffle depended from the top cap. A patent of interest is the patent to Couch et al., U.S. Pat. No. 3,390,225, issued on June 25, 1968, for Underground Electrical Vault.

Such underground vaults and manholes were generally made of heavy reinforced concrete with the tubular body thereof made of a light gauge metal. The metal body was usually corrugated for rigidity. At times the body was formed of a bituminized fiber or cardboard in combination with reinforced concrete top cap. In some instances, the top cap was made of cast iron. Such structures with reinforced concrete and cast iron top caps were usually quite heavy, weighing in the vicinity of 500–700 pounds depending on the size. The installation thereof required special lifting equipment.

Reinforced concrete top caps were subject to chipping and cracking from field handling and from traffic loads. Bituminized fiber bodies were lighter than reinforced concrete bodies, but also were weaker. Hence, they were relatively easily damaged during installation and by unstable soil conditions. Metal bodies were undesirable because of their susceptibility to corrosion and galvanic attack. Also, they presented a safety hazard when used in conjunction with high voltage equipment.

SUMMARY OF THE INVENTION

An underground enclosure comprising a fiberglass polyester resin housing on which is seated a reinforced plastic mortar top cap.

A feature of the present invention is the reinforcement of the rigidity of the body by reinforced plastic mortar rings and struts.

The top cap has a central opening on which top cap is seated a metal grating. Alternatively, a reinforced plastic mortar cover plate may be seated on the top cap.

Another feature of the present invention is a baffle of fiberglass polyester resin that depends from the top cap into the body.

By virtue of the present invention, a lightweight, high strength enclosure is achieved that is safe and is highly resistant to corrosion as well as galvanic attacks. With the increased demand for utility vaults created by the placement of power and communication utilities underground, there is a present need for lightweight, strong vaults which can be shipped and installed with facility and ease of operation.

Reinforced plastic mortar caps meet the structural requirements for light vehicular traffic loading, while reinforced concrete top caps require a heavy steel frame and beams to meet the same loading conditions.

Applicant of the present application has filed an application on Reinforced Plastic Mortar Underground Enclosures, Ser. No. 191,390, filed on Oct. 21, 1971.

DESCRIPTION OF THE DRAWINGS

FIG. 1 is a perspective view of the underground reinforced plastic enclosure embodying the present invention.

FIG. 2 is a vertical section view of the underground reinforced plastic enclosure taken along line 2—2 of FIG. 1 and illustrated installed in soil.

FIG. 3 is an exploded view of the underground reinforced plastic enclosure shown in FIG. 1.

FIG. 4 is a plan view of the top cap of the enclosure shown in FIG. 1.

FIG. 5 is a vertical section view taken along line 5—5 of FIG. 4.

FIG. 6 is a diagrammatic plan view of an assembled mold for producing the top cap shown in FIGS. 4 and 5.

FIG. 7 is a diagrammatic vertical sectional view taken along line 7—7 of FIG. 6.

DESCRIPTION OF THE PREFERRED EMBODIMENTS

Illustrated in FIGS. 1–5 is the reinforced plastic enclosure 10 embodying the present invention which comprises a body 15, which may be rectangular in cross-section or may have a cylindrical configuration. The body 15 is suitable as an enclosure for an underground utility transformer or an underground utility oil switch. In use, the body 15 is disposed in soil. (FIG. 2).

The body 15 is seated on a base 20 which is illustrated as having a disc configuration. However, the shape of the base 20 will conform to the configuration of cross-sectional area of the body 15. Seated on the body 15 is a top cap 25, which has a rectanguloid configuration and is formed with a central cylindrical opening 26. A rectangular recessed area 27 is formed from the upper wall of the top cap 25. When the enclosure 10 is in use, the top cap 25 will be disposed at ground level. (FIG. 2).

A metal grate 30, or optionally a solid reinforced plastic mortar cover plate, is seated on the top plate 25 within the recess 27. Depending from the top cap 25 radially outward from the body 15 is a grade adjustment skirt 35 (FIGS. 1–3) and depending from the top cap 25 radially inward from the body 15 is a baffle and tamper shield 40. (FIGS. 2 and 3). Radially disposed grooves 41 (FIGS. 3 and 4) are formed in the upper wall of the top cap 25 to receive support arms 42 (FIG. 3) of the baffle and tamper shield 40. When a utility maintenance or installation employee desires to gain access into the body 15, the grating 30 is temporarily removed from the top cap 25.

The base 20 is supported by the soil below the level of the ground and is formed from a reinforced plastic mortar. Projecting upwardly from the top wall of the base plate 20 is a ridge 50 (FIGS. 2 and 3). Seated on the base 20 is the body 15 with the interior surface of the body 15 abutting against or contiguous with the outer wall of the ridge 50. Since the exemplary embodiment of the body 15 shows a cylindrical wall, the ridge 50 has an annular configuration. An opening 51 is formed axially of and through the disc base 20 for drainage of water, moisture or the like that may collect in the body 15. Should it be desired to fix the body 15 to the base 20, suitable bolts and brackets may be provided, such as the ones employed to secure the top cap 25 to the body 15.

From FIGS. 1–3, it is seen that the body 15 is disposed on the base 20 with the axis thereof in the upright position. The body 15 is made from a fiberglass polyester resin. Optionally, the body 15 may be preformed as a cylinder, or may be separated along confronting longitudinal edges, or may be separated along diametrically opposite confronting longitudinal edges. The separation of the body 15 along longitudinal edges is for convenience of handling and shipping. When assembled, suitable nuts and bolts secure projecting flanges of confronting edges to form a cylindrical body.

For reinforcing the body 15, annular ribs 55 (FIGS. 1 and 2) and longitudinal ribs 56 are formed along the exterior wall thereof. The annular ribs and the longitudinal ribs are formed from reinforced plastic mortar. The annular and longitudinal stiffeners 55 and 56 provide rigidity to the body 15 for resisting earth loads. Formed in the body 15 are suitable knockouts shown by scoring 57 (FIG. 1), which are respectively removed when it is desired to have conduits received by the body 15. When the body 15 encloses a transformer, it is generally of greater dimension longitudinally then when it encloses an oil switch.

The top cap 25 is made from a reinforced plastic mortar 70. (FIGS. 2, 5 and 7). All reinforced plastic mortar 70 employed herein is formed in a similar manner and contains similar ingredients. Hence, only the formation of the reinforced plastic mortar 70 for the top cap 25 will be described in detail. The reinforced plastic mortar 70 comprises an outer layer 71 and an inner layer 73. Both layers 71 and 73 are of high strength glass filament, mat, woven cloth or woven roving. The thickness and type of material of the layers 71 and 73 are determined by the strength requirement for the mortar 70.

In addition, the reinforced plastic mortar 70 includes a core 72 which is sandwiched between the layers 71 and 73. The core 72 is composed of a synthetic thermosetting resin or a synthetic plastic resin of the thermosetting type, such as polyester, epoxy, furane, polyurethane and the like. The thermosetting resin is filled with inert or inorganic fillers or graded aggregate material. The filler may be in the form of sand or gravel or a combination thereof.

In the process of producing the top cap 25, a suitable mold assembly 80 (FIGS. 6 and 7) is employed which may be made from metal or fiberglass. Initially, the outer layer 71 of glass filament is applied to the recessed surface of the mold assembly 80 (FIG. 7). The outer layer 71 of glass filament is applied to the recessed wall of the mold assembly 80 by brushing or spraying a thin film polyester thermosetting resin with thixotropic fillers and ultra violet suppresents on the recessed wall of the mold assembly and then placing the glass filament thereupon. In areas where abrasive surfaces are present, sand or quartze particles may be added. Additional layers of reinforcing glass filament are added to form stratified layers. The additional layers may be added by spray-up or by manually adding a woven mat of glass filament.

Thereupon, a mixture of thermosetting resin and filler forming the core 72 is placed into the recessed area of the mold assembly. Alternatively, a slurry of thermosetting resin and filler forming the core 72 may be placed into the recessed area of the mold assembly 80. The type of filler employed would depend on the strength requirements of the core material. In an exemplary embodiment for a dry mix, the thermosetting resin for the mixture constitutes about 3% by weight and the aggregate filler may be of a size in the range of ⅛ inch to ¼ inch. This mixture would be porous in composition and yield a compressive strength in the vicinity of 500 p.s.i. The slurry mix, in the exemplary embodiment, may be 20% of thermosetting resin content by weight and the filler of a mixture of aggregate and sand. A core produced thereby would be non-porous in composition and yield a compressive strength of 30,000 p.s.i.

Now, the inner layer 73 of glass filaments, similar to the outer layer 71 of glass filament, is placed on top of the recessed area of the mold assembly 80. At this time, threaded inserts or threaded studs may be positioned in the appropriate places to become an integral part of the top cap 25.

The thermosetting resin polymerizes or hardens. The polymerization can be accomplished at room temperature or it can be accelerated by heat. The heating of the mold assembly 80, although not required, will accelerate the curing of the thermosetting resin. When the mold assembly 80 is heated to 150°F., the top cap 25 can be removed from the mold assembly 80 in 15 minutes. Otherwise, the top cap 25 can be removed in approximately 1 hour depending upon the exotherm for cure.

The top cap 25 is secured to the upper portion of the body 15 by means of brackets and bolts as shown in FIG. 2. The baffle and tamper shield 40 is made of a fiberglass reinforced plastic. As previously described, the cross-arms 42 project outwardly and seat in the grooves 41 of the top cap 25 for depending the baffle and tamper shield 40 from the top cap 25. Carried by the cross arms 42 is a tubular member 90 (FIGS. 2 and 3), which is secured thereto by means of brackets and bolts. The upper wall of the member 90 is bevelled and defines an annular opening 91. Also fixed to the cross arms 42 is a tamper shield 92 that is disposed within the tubular member 90 along the axis thereof. The baffle 92 has a centrally disposed disc plate **92*a* with an inwardly flared apron 92*b*** depending therefrom.

The baffle-tamper shield 40 serves two functions. Firstly, it prevents access to the equipment enclosed by the body 15 while the grate 30 is installed on the top cap 25 and yet provides a path for the conduction of heat generated within the body 15 to escape through the grate 30.

The grade adjustment skirt 35 is made of reinforced plastic mortar and has a cylindrical configuration and is fixed to the top cap 25 by brackets and nuts to depend therefrom. The body 15 is disposed in the soil slightly below the ground level. On the other hand, the top cap 25 is disposed along the finished ground level. As a consequence thereof, a gap may exist between the top cap 25 and the upper end of the body 15. The grade adjustment plate 35 occupies the gap between the body 15 and the top cap 25 to act as a stop for preventing dirt from seeping into the body 15. Thus, the grade adjustment plate serves as a dirt stop for the gap between the body 15 and the top cap 25, and also serves to enable the top cap 25 to be adjusted for occupying a position along the grade level of the ground. The axial length of the skirt is determined by the degree of adjustment required for the top cap 25.

I claim:

1. An enclosure for underground installations comprising:

a body of fiberglass material;

stiffeners on said body for rigidifying said body, said stiffeners being of reinforced plastic mortar; and a top cap on said body of reinforced plastic mortar, said top cap being formed with a central opening communicating with said body, said top cap being formed with radially disposed grooves projecting radially from said central opening and comprising a baffle and a tamper shield having radially disposed arms seated in said grooves for supporting said baffle and said tamper shield from said top cap.

2. An enclosure as claimed in claim 1 wherein said baffle and tamper shield comprise an outer tubular member supported by said arms, a central disc supported by said arms in spaced relation to said tubular member and an apron supported by said central disc in spaced relation to said tubular member.

3. An enclosure as claimed in claim 1 wherein said baffle and tamper shield is made of fiberglass material.

4. An enclosure as claimed in claim 1 and comprising a grade adjustment skirt fixed to said top cap and depending therefrom radially outward from said body.

5. An enclosure as claimed in claim 4 wherein said grade adjustment skirt is made of reinforced plastic mortar.

6. An enclosure as claimed in claim 5 wherein said baffle and tamper shield is made of fiberglass material.

7. A top cap for underground installations comprising:

a body formed with a central opening, said body being recessed outwardly from said opening; and a baffle and tamper shield, said baffle and tamper shield comprising a center base, means fixed to said center base and seated in said recesses of said body to support said center base within said central opening of said body, an inverted disc member disposed in said opening and depending from said base, said base and said inverted disc member forming a tamper shield, and a tubular baffle disposed in said opening and depending from said means outwardly and in spaced relation with said tamper shield.

8. A top cap as claimed in claim 7 and comprising a grade adjustment skirt fixed to said body and depending therefrom outwardly of said opening.

9. A top cap as claimed in claim 8 wherein said body is of reinforced plastic mortar.

10. A top cap as claimed in claim 9 wherein said baffle and tamper shield is of fiberglass material.

11. A top cap as claimed in claim 9 wherein said grade adjustment skirt is of reinforced plastic mortar.

* * * * *